United States Patent [19]

Stoody

[11] 4,405,064

[45] Sep. 20, 1983

[54] SELF-CLEANING, ISOLATED PRODUCT, AEROSOL SPRAY ATOMIZING VALVE

[76] Inventor: William R. Stoody, 8659 Summerdale Rd., San Diego, Calif. 92126

[21] Appl. No.: 266,747

[22] Filed: May 26, 1981

[51] Int. Cl.[3] ..... B65D 83/00; B65D 83/14

[52] U.S. Cl. ..... 222/148; 222/402.17; 222/402.18; 222/402.24; 222/136

[58] Field of Search ..... 222/402.16, 402.17, 222/402.18, 402.24, 148, 136

[56] References Cited

U.S. PATENT DOCUMENTS

| | | | |
|---|---|---|---|
| 3,469,744 | 9/1969 | Corsette | 222/402.18 X |
| 3,495,744 | 2/1970 | Webster | 222/402.24 |
| 3,497,112 | 2/1970 | Samuelson | 222/402.18 X |
| 3,525,456 | 8/1970 | Prussin et al. | 222/148 X |
| 3,606,963 | 9/1971 | Marand | 222/402.18 X |

*Primary Examiner*—David A. Scherbel

[57] ABSTRACT

This disclosure relates to a manually operated, self-cleaning, aerosol valve that has separate control elements for propellant fluid and product fluid. The valve is adapted to maintain internal separation of the fluids. Even when the fluids are codispensed to produce a fine mist, separation of the propellant from the product is maintained until the fluids are beyond control elements. Control elements also maintain internal separation of the fluids when the valve is actuated for purging. This is achieved by keeping the fluid product control element closed while the propellant control element is open. With the control elements so positioned, cleaning fluid can be directed to purge all passageway surfaces that are exposed to external air. This type of valve is particularly suited for dispensing viscous products, such as water-borne paints.

6 Claims, 10 Drawing Figures

SELF-CLEANING, ISOLATED PRODUCT, AEROSOL SPRAY ATOMIZING VALVE

BACKGROUND OF THE INVENTION

The development of water-borne spray paint has created the need for the present invention. Valves for water-borne paint must be capable of maintaining separation of propellant and paint. They must also be able to thoroughly purge residue from discharge surfaces. Unlike other aerosol products, water-borne paints are not compatible with propellants in their liquefied state.

Heretofore aerosol valves either relied on mixing propellant with product, or they failed to adequately purge residue from discharge passageway surfaces. Water-borne paint residue remaining in valve discharge passageways quickly drys, clogging the valve and rendering it useless. The hydrocarbon propellants which become the primary pressurizing fluids after the ozone depletion controversy, cause coagulation within valves when mixed with water-borne paint. Mixing of other propellants with water-borne paint produces a detrimental froth.

PRIOR ART

U.S. Pat. No. 3,583,606 exemplifies the failure to adequately purge valves. As seen in FIG. 11 of the patent specifications, orifice 132 cannot be purged of detrimental product residue. Even though orifice 130 and the upper portion of channel 38 can be purged, residue will remain in orifice 132 and the lower end of channel 38. Since channel 38 is open to external air, the remaining residue will harden and render the valve useless. While some products can tolerate this condition, it cannot be tolerated by water-borne paint aerosols.

SUMMARY OF THE INVENTION

The present invention is a novel valve consisting of a first fluid transit chamber, and a lower second fluid transit chamber. Within each chamber, an individual control element is resiliently disposed. The first chamber control element regulates discharge passage of pressurizing fluid, and the second chamber control element regulates discharge passage of product fluid. Said control elements are adapted to be sequentially and independently unseated by actuation of a common dispensing means, to effect co-fluid dispensation. Separation of fluids within the said transit chambers is maintained by a gasket sealing means that separates the said chambers.

For purging of residue from the dispensing means, fluid is diverted from the first fluid transit chamber to discharge orifices and passageway surfaces that are on the outlet side of said second chamber control element. To effect purging the said dispensing means must be partially rotated and fully depressed.

It is an object of the present invention to provide an aerosol valve that is capable of maintaining separation of fluid product from propellant in liquid form prior to discharge.

Another object is to provide an aerosol valve through which propellant can be introduced for separate storage within an aerosol container that has been prefilled with a product fluid.

Another object is to provide an aerosol valve that is capable of inducing a fine spray mist from viscous fluid products that are incompatible with propellants in their liquefied state.

A further object of the present invention is to provide a valve that can be purged without mixing fluids awaiting discharge.

These and other objects and advantages will be seen from the following specification in conjuction with the appended drawings. It will be understood that the specification and drawings are for the purpose of illustration and do not define the scope or limits of the invention.

THE DRAWINGS

Figure 2:
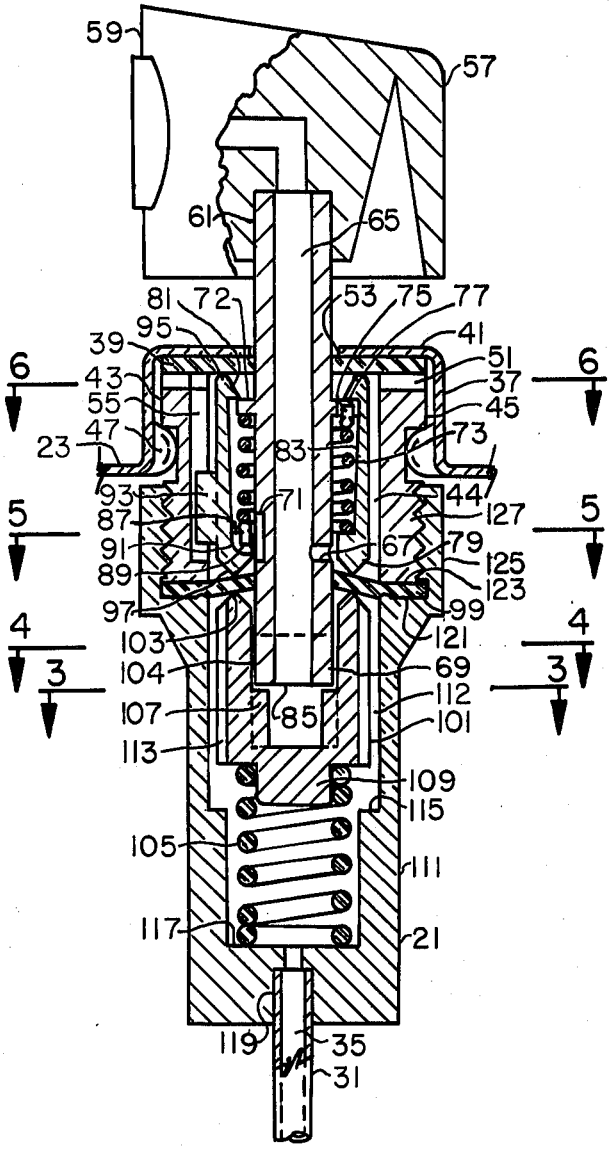
FIG. 2, is a longitudinal sectional view of the valve in its normally closed condition.

FIGS. 3, 4, 5 and 6, are sectional views taken from the line 3—3, line 4—4, line 5—5 and line 6—6 respectively, of FIG. 2.

Figure 7:
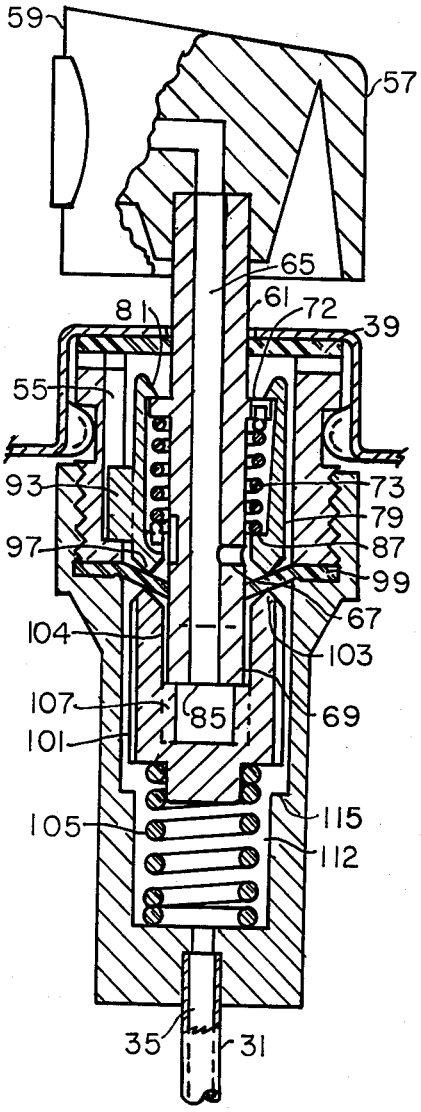

FIG. 7, is a longitudinal sectional view of the valve partially actuated.

Figure 8:
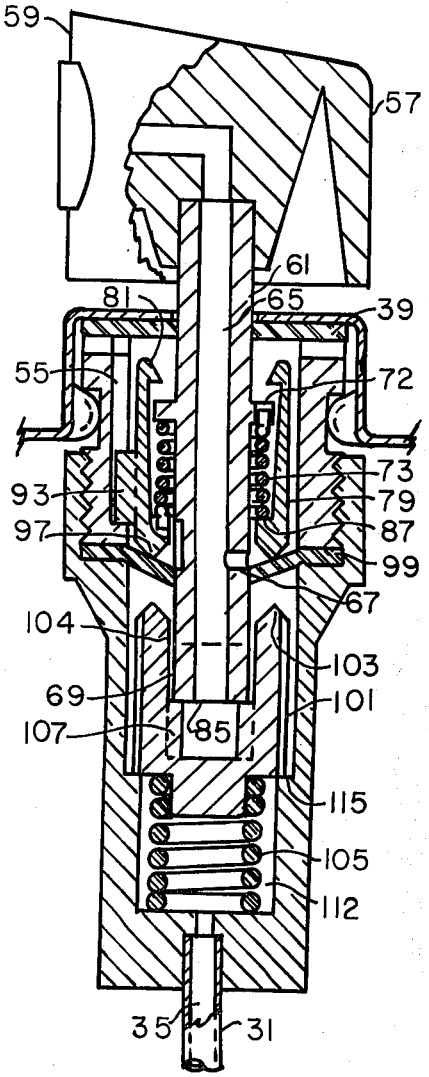

FIG. 8, is a longitudinal view depicting the valve in a fully open position.

Figure 9:
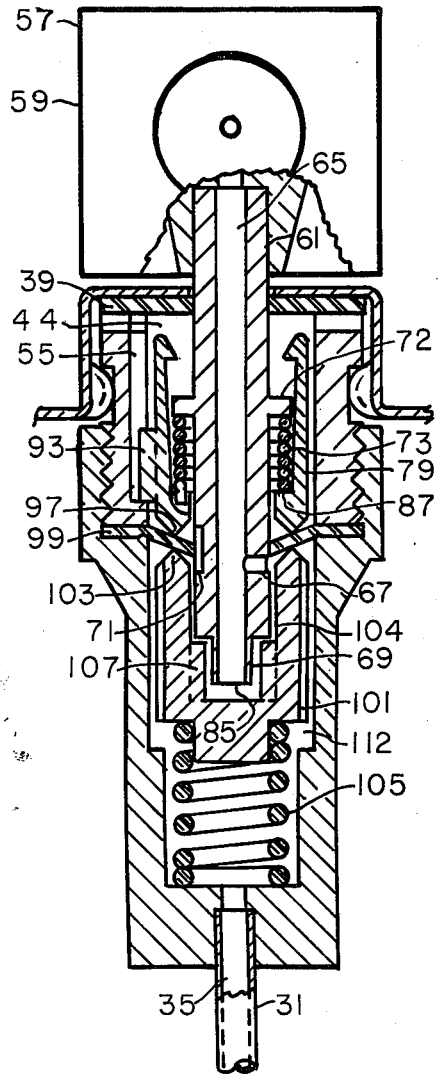

FIG. 9, is a longitudinal view depicting the valve in a self-cleaning position.

Figure 10:
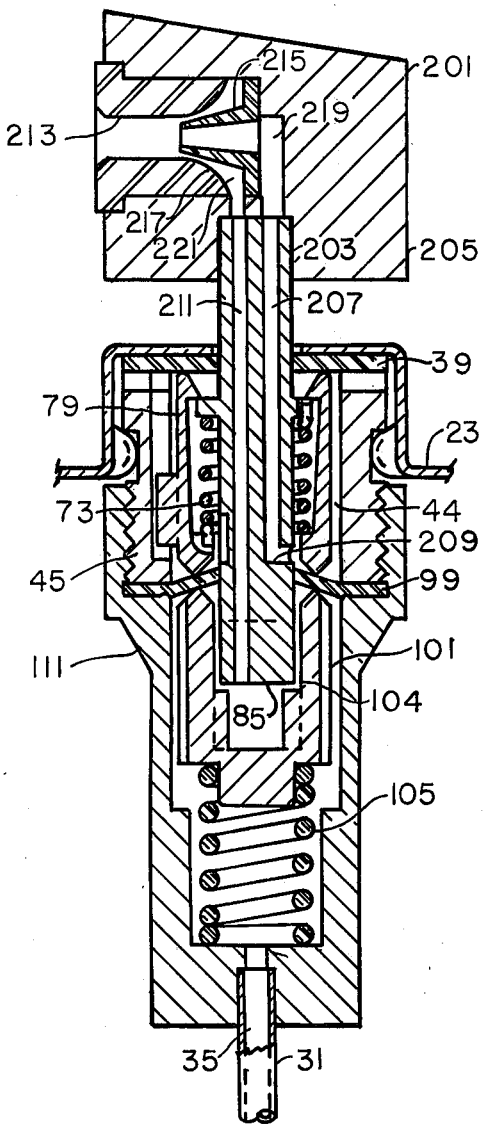

FIG. 10, is a longitudinal sectional view of a modification of the valve.

DESCRIPTION OF THE PREFERRED EMBODIMENT

Figure 1:
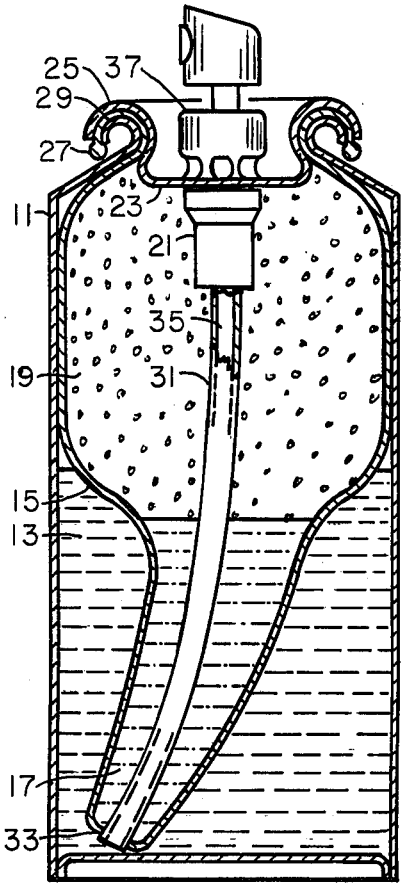
FIG. 1, is an axial sectional view depicting the valve and related aspects of an aerosol dispenser.

Referring to FIG. 1, shown in longitudinal cross section, an aerosol container 11 of substantially conventional structure within which is disposed a dispensible product, second fluid 13. Projecting downwardly from the top opening of container 11 is an expansible sac 15 which contains a liquefied propellant gas, first fluid 17, and propellant vapor 19.

Closure of container 11 is established by a normally closed valve mechanism 21 which includes an assemblage retainment member 23, commonly referred to as a valve cup. Peripheral rim curl 25 of valve cup 23 is adapted in secure sealing engagement with an annular open end 27 of sac 15, and top opening curl 29 of container 11. In addition, by virtue of a central cup shape protrusion 37, valve cup 23 provides the primary means of retaining valve mechanism 21 in a single definable unit.

A flexible tubular conduit 31 depending from valve mechanism 21, sealingly engages and extends through an aperture 33 provided in a lower wall of sac 15. Conduit 31 thereby defines an enclosed valve inlet passageway 35, within the said first fluid confinement sac 15. Passageway 35 provides a means for said second fluid 13 to separately enter valve mechanism 21 for dispensation which will be described later in detail.

As seen in FIG. 2, valve mechanism 21, in addition to valve cup 23, comprises of:

a dispensing head 59, stem 61, first fluid control element 79, second fluid control element 101, body adapter 45, and valve body 111, all of which are generally considered to be moldable from plastics;

and, a first sealing means 39 and second sealing means 99, said sealing means are resilient rubberlike gasket discs having a circular center opening;

and, stem spring 73 and main spring 105, which are normally formed metal components as is valve cup 23.

Figure 6:
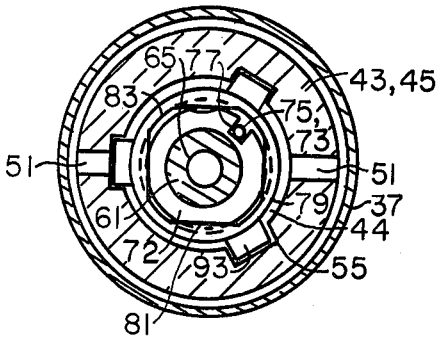

Within cup shape protrusion 37 of valve cup 23, first gasket 39 is retained intermediate end closure 41 of protrusion 37 and an annulet brim 43 of body adapter 45 which is a sleeve-like housing. Indented annular intermittent crimps 47 formed in the walls of protrusion 37 securingly engage bottom peripheral corner of brim 43 and, as shown in FIG. 6, groove 51 recessed into and extending across the top surface of brim 43, provides a first fluid inlet communicating flow passage between the interior of sac 15 and a first fluid transit chamber 44 which is defined by interior surfaces of body adapter 45. Spaced about the walls of first fluid chamber 44 are longitudinal grooves 55.

Dispensatory means 57 is established by dispensing head 59 and stem 61 which projects outwardly from a central opening 53 in end closure 41 of valve cup 23. Dispensing head 59 is coupled to the protruding end of stem 61 by bonding or other means that will cause head 59 and stem 61 to function as a single part.

Dispensing head 59 is adapted to produce a desired final dispensing form of discharged fluids. Stem 61, a tubular shaped member, has a longitudinal passageway 65 that provides a communication means between dispensing head 59 and the interior of valve mechanism 21. Dispensable product second fluid 13 can enter the bottom open end of passageway 65, and propellant first fluid 17–19 can enter passageway 65 through an orifice 67.

Figure 4:
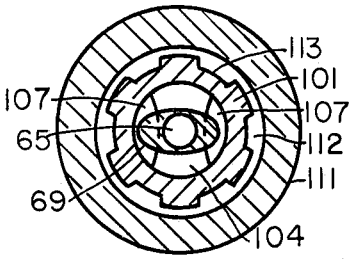
Figure 5:
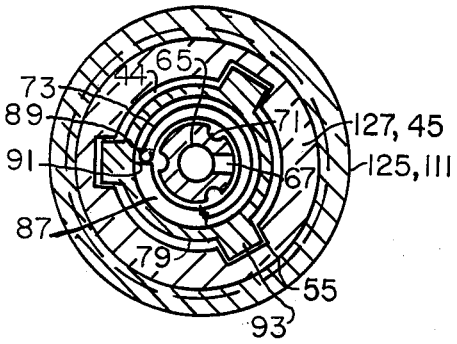

Dispensing head 59 is spaced a predetermined depressable distance above protrusion 37 by stem 61 which passes slidably and sealingly through the said center opening of first gasket 39, before clearingly projecting from said center opening 53. Below gasket 39, said stem 61 has an intrinsically formed annulet shoulder 72 the bottom surface thereof providing a bearing surface against which the end coil of stem spring 73 is seated. Spring 73 is disposed coiled about stem 61 and has an upturned end 75 that is engaged in notch 77 in shoulder 72, this can be seen in FIG. 6. Centrally located about the external surfaces of stem 61 are a plurality of longitudinal propellant vapor by-pass grooves 71 that are best seen in FIG. 5. The lower portion of stem 61 transforms into an oblong shape 69 as seen in FIG. 4, and hereinafter explained in detail. Bottom tangent of orifice 67 and bottom end of by-pass grooves 71 in stem 61 are situated in the same plane. It will later be seen that the features just described establish a means for purging passageways of dispensatory means 57.

Stem spring 73 and stem 61 are centrally retained within first fluid control element 79 which is a sleeve-like component slidingly nested within first fluid transit chamber 44. Said control element 79 is adapted to snap over shoulder 72. A forceful engaging pressure pushes shoulder 72 past yielding latching projections 81 internally provided in top open end of said control element 79. Latching projections 81, as seen in FIG. 6, form a square-like end opening in the otherwise circular bore 83 that is sized to permit axial movement of shoulder 72 and spring 73. Spring pressure exerted against shoulder 72 causes the top surface of shoulder 72 to retainingly rest against latching projections 81. The lower internal end of first fluid control element 79 is abruptly reduce in diameter to a slip-fit relationship with stem 61. Terminus 85 of stem 61 extends a significant distance beyond the lower end of said control element 79. Diametrical differences in lower end of said control element 79 provides a ledge 87 against which the lower coil end of spring 73 is respondingly seated and as shown in FIG. 5, a downturned end 89 of spring 73 is engaged in a notch 91 provided in ledge 87.

The said upturned and downturned spring ends 75 and 89 in conjunction with the said notches 77 and 91 enable spring 73 to provide a reciprocating force to rotational movement of dispensatory means 57. Likewise, seated coil ends of spring 73 enable reciprocation of spring 73 from downward movement of dispensatory means 57.

First fluid control element 79, being nested slidingly within first fluid transit chamber 44, is provided with a longitudinal travel distance that is limited to the distance necessary to unseat control element 79 from sealing engagement with gasket 39. Overtravel as well as untolerable rotational movement is prevented, as shown in FIG. 5, by a plurality of longitudinal bosses 93 spaced about the external surface of control element 79. Bosses 93 interlock with the previously said longitudinal grooves 55 along the internal wall surface of body adapter 45, within said chamber 44. The said grooves 55 extend from the top end opening to a meaningful distance above the bottom end opening of adapter 45. The bottom surfaces of bosses 93 are situated above the lower ending of grooves 55 so as to provide a gap that governs downward travel of said first fluid control element 79.

The top end of first fluid control element 79 abuts the bottom surface of first gasket 39 in a sealing relationship. Internal walls and external walls of control element 79 merge to an annular top rim 95 having a cross sectional thickness in the range of 0.010 to 0.015 inch, to assure a sealing compression force against gasket 39 when valve is in a normally closed mode.

The bottom open end of control element 79 is provided with a bottom annular rim 97 which is functionally similar to said top rim 95. However the said bottom rim abuts the top surface of second gasket 99 which is in compression intermediate the said bottom rim 97 and a top annular opening rim 103 of second fluid control element 101. The said top annular opening rim of second fluid control element 101, for the intended purpose, is characteristically the same as the annular rim end opening of first fluid control element 79. Sealing pressure exerted to both, control element 101 and control element 79 is imparted by main spring 105 which in its preloaded state is significantly more forceful than stem spring 73.

The previously said lower end portion of stem 61, extending below first fluid control element 79, extends slidingly and sealingly through the said center opening of second gasket 99 and clutchingly couples with the closed bottom central bore 104 in second fluid control element 101. The said terminus 85 of stem 61 is spaced slightly above convex sectorlike diametric shelves 107 inwardly projecting in the lower portion of said bore, in said control element 101. Height of the said diametric shelves as well as the axial length of the previously said oblong shape 69 of stem 61, is greater than permissible downward travel of the said dispensatory means 57. Diametric shelves 107 are sized so that in a dispensing mode, as seen in FIG. 8, elongated ends of the oblong shape 69 terminus 85 bears downwardly against the diametric shelves 107 conveying an unseating force to control element 101 and thereby causing main spring 105 to cooperatively yield. In a valve cleaning mode with oblong shape 69 terminus rotated 90 degrees, as shown in FIG. 9, space between diametric shelves 107 permits unrestricted passage of terminus 85, this prevents unseating of control element 101.

A nub 109 centrally located on the external bottom surface of control element 101, provides a spring centering means, positioning the seated top end coil of main spring 105 that bears against the adjacent surface of the said second fluid control element. The bottom coil of spring 105 reciprocally bears against the inside bottom surface 117 of valve body 111.

Figure 3:
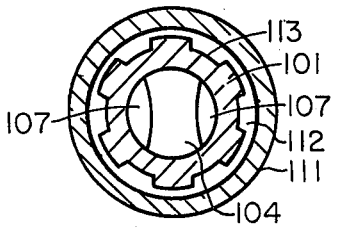

In cross section as seen in FIG. 3 and FIG. 4, control element 101 externally is circular in shape and nested in a slip-fit relationship with the upper portion of inside surfaces of valve body 111. A plurality of longitudinal grooves 113 extend the full length of the outer surfaces of control element 101 that are adjacent to inside surfaces of valve body 111. The said grooves assure that passage of dispensable product is restricted only by sealing relationship of control element 101 and gasket 99. At a distance that permits approximately 0.075 inch of downward movement of said element 101, as seen in FIG. 7 the lower inside portion of valve body 111 is reduced in diameter, forming ledge 115 which prevents overtravel of element 101. The distance between ledge 115 and element 101 is such that when in a dispensing mode, orifice 67 and by-pass grooves 71 of stem 61, are situated imediately above second gasket 99. At the bottom end 117 of valve body 111 centrally located is an aperture 119 adapted to sealingly receive second fluid inlet conduit 31, hereinbefore described.

At the upper end of valve body 111 second gasket 99 is sealingly secured between a seating surface 121 of the said valve body, and the bottom end surface 123 of the said body adapter 45, thereby establishing within valve body 111 a second fluid transit chamber 112 through which said second fluid must pass before being discharged.

The central portion of gasket 99 intermediate said first and second control elements 79 and 101 is deflected upward approximately one-half of the travel distance required to fully unseat first fluid control element 79 from its hereinbefore described seated position against first gasket 39. For valve actuation, said central portion of gasket 99, as seen in FIG. 7 and FIGS. 8 and 9, deflects downwardly a distance approximately equal to the said upward distance.

Coupling of valve body 111 with the said body adapter 45 is accomplished by an internally threaded collar 125 that extends upwardly from the periphery of the said second gasket seating surface 121 in the upper end of valve body 111, in secure threaded engagement with an externally threaded flange 127 at the lower end of body adapter 45. The said coupling is merely one of many options that would be equally suited.

Referring to FIGS. 7 and 8, in longitudinal cross section the hereinbefore described valve components are shown in sequential dispensing stages resulting from downward actuation pressure against dispensatory means 57.

In the first stage, an initial 0.015 to 0.025 inch of downward actuation, as seen in FIG. 7, permits only release of propellant vapor, preventing undesired premature unatomized discharge of product. The said actuation correspondingly presses oblong shape terminus 85 against diametric shelves 107 of second fluid control element 101 causing a slight compression of main spring 105. Simultaneously with the downward movement of said control element 101, first fluid control element 79 is downwardly unseated from its engagement with first gasket 39. The downward movement of element 79 causes the central portion of gasket 99 to deflect and remain in sealing compression intermediate said rims 97 and 103 of the respective control elements. This prevents premature release of dispensible product from second fluid transit chamber 112.

Unseating of first fluid control element 79 results from pressure exerted against said element ledge 87 by stem spring 73 which respondingly bears against annulet shoulder 72 of stem 61. With said control element 79 unseated, propellant vapor can freely enter orifice 67 in stem 61, and subsequently be discharged by dispensing head 59 of dispensatory means 57.

The herein described initial dispensing stage is defined by the travel permitted by the said gap between the bottom surface of element 79, bosses 93 and the said ending of longitudinal grooves 55 described in reference to FIG. 2. Control element 79 is thereby prevented from further downward movement, thereafter continued downward movement of dispensatory means 57 begins the second dispensing stage.

As shown in FIG. 8, in the second stage of dispensing, stem spring 73 yielding compresses in response to the additional travel of stem 61 annulet shoulder 72. Since element 79 must remain stationary, shoulder 72 moves away from latching projections 81 in element 79. Terminus 85 of stem 61 continues to push against diametric shelves 107 and thereby unseats annular rim 103 of control element 101 from its heretofore sealing engagement with second gasket 99, and main spring 105 yieldingly compresses. Downward overtravel of element 101 is prevented by ledge 115.

In this dispensing stage product under pressure can enter second fluid transit chamber 112 through passageway 35 of conduit 31, and flow over annular rim 103 to the outlet side of control element 101, through bore 104, along side of oblong portion 69 and into stem 61 and therein be mixed with propellant vapor before being discharged from dispensing head 59. In rush pressure of the said propellant and the said product entering stem 61 will prevent either fluid from prematurely exiting within said transit chambers.

Dispensing is halted when actuation pressure against dispensatory means 57 is removed. Reciprocal pressure exerted by main spring 105 and stem spring 73 returns all of the said valve components to their respective normally closed positions in a sequence reversed from that described above.

Referring now to FIG. 9, in longitudinal cross section the hereinbefore described valve components are shown with the dispensatory means 57 fully depressed and rotated 90 degrees. Actual method of depressing and holding are not shown since it is assumed to be a hand held operation. As it can be seen, in this mode the said second fluid control element 101 remains sealed against second gasket 99. In this mode propellant vapor can be directed into bore 104 of element 101 without contaminating product waiting to be discharged.

Responding to downward pressure applied against dispensatory means 57 while in a rotated position that is 90 degrees from normal, oblong shape 69 terminus 85 of stem 61 aligns in a slip-fit relationship with diametric shelves 107 in bore 104. This prevents engagement of stem 61 with second control element 101. Rotational and downward pressure exerted against dispensatory means 57 are transferred directly to annulet shoulder 72 of stem 61 and therefrom by virtue of stem spring 73, to said first control element 79.

Compression of stem spring 73 bearing against ledge 87 in said element 79 forces element 79 downward causing bosses 93 to seat against the lower ending surface of grooves 55 in transit chamber 44, element 79 is thereby unseated from its hereinbefore described sealing engagement with first gasket 39. Second gasket 99 deflects downwardly, however it remains in compression intermediate annular rims 97 and 103. The total permitted downward movement of both control elements is in the range of 0.015 to 0.025 inch, however stem 61 moves downward until stem spring 73 is fully compressed, approximately 0.125 inch. The additional movement of the said stem 61 places orifice 67 and a portion of by-pass grooves 71 below second gasket 99. A portion of by-pass grooves 71 also remain above gasket 99.

With orifice 67 and by-pass grooves 71 positioned as just described, purging discharge of propellant vapor can be thereby directed through by-pass grooves 71 and into bore 104 before being permitted to enter stem 61 and subsequent discharge from dispensing head 59. As it can be seen, all passageway surfaces that are exposed to outside air are purgable.

The hereinbefore described reciprocation force of stem spring 73 and main spring 105 cause all valve components to return to their normally closed positions when said dispensatory means is released.

The above described cleaning position also permits initial pressurizing introduction of a desired propellant through the said valve mechanism without mixing fluids. This can be achieved because separate communication into the internal confinements of sac 15 can be established, and propellant passage through second transit chamber 112 is prevented.

MODIFICATION

A modified dispensatory means 201 is shown in FIG. 10, here a modified stem 203, in place of previously said stem 61, is joined with a dispensing head 205, which is used in place of previously said dispensing head 59. Head 205 is adapted to utilize discharge pressure of previously said first fluid to create a suction pressure to draw previously said second fluid into head 205 for mixing and subsequent discharge with first fluid.

To accommodate said dispensing head 205, stem 203 is provided with separate longitudinal passageways in place of previously said passageway 65. A first fluid passageway 207 that includes orifice 209, in place of previously said orifice 67, provides direct communication from first fluid transit chamber 44 to said dispensing head 205. A second passageway 211, provides direct communication from second fluid transit chamber 112. Other features and operations are as previously described for valve mechanism 21.

Referring specifically to said dispensing head 205, as seen in FIG. 10, head 205 is an ejector type dispensing device that includes diffuser 213 to mix departing fluids. Head 205 also includes a motive gas nozzle 215, a venturi throat 217, a motive gas inlet passageway 219, and a suction chamber 221, to create a suction pressure.

The suction pressure is capable of drawing said second fluid into said dispensing head 205 when said first fluid is being discharged and dispensatory means is depressed for co-fluid dispensing. Said second fluid can only be discharged when said second fluid control element 101 is unseated from said gasket 99.

Specific terminology resorted to in describing the illustrative embodiments is not intended to be limiting. It is understood that this is for clarity and includes all technical equivalents which function in a similar manner to accomplish a similar purpose or results.

Having described my invention, reference should now be had to the following claims.

I claim:

1. A self-cleaning dispensatory valve for co-fluid dispensing, adapted to maintain separation of a pressurizing first fluid from a second fluid prior to effluence, which comprises;

a first fluid transit chamber having a first fluid discharge control element resiliently located therein;

a second fluid transit chamber having a second fluid discharge control element resiliently located therein;

an assemblage retainment member mounted on said first fluid transit chamber;

a first sealing means securingly disposed interjacent said assemblage retainment member and said first fluid transit chamber;

a second sealing means separating said first fluid transit chamber from said second fluid transit chamber;

a dispensatory means which includes a dispensing head and discharge communication passageways extending from said first and second fluid transit chambers to said dispensing head;

said dispensatory means being adapted to co-operatively interosculate said first and second fluid discharge control elements to selectively effect discharge of said fluids;

said second fluid discharge control element having outlet surfaces which remain in communication with said dispensing head;

said dispensatory means further including a fluid by-pass means which is adapted to purgingly direct fluid from said first fluid transit chamber to said outlet surfaces of said second fluid discharge control element and therefrom effect cleaning of said dispensatory means while maintaining the integrity of first and second fluids awaiting discharge.

2. In the invention of claim 1, said dispensatory means being resiliently coupled with said first fluid control element in a manner that motivates reciprocation of said dispensatory means from rotational and axial movement.

3. In the invention of claim 2, said first fluid control element being restrained from rotational movement, and having limited axial movement which is less than full axial movement of said dispensatory means.

4. In the invention of claim 1, said second fluid control element being clutchingly coupled with said dispensatory means.

5. In the invention of claim 1, said dispensatory means discharge communication passageways being separate passageways for flow of said first and second fluids from their respective transit chambers to said dispensng head, as well as, outlet passageways of said dispensing head.

6. In the invention of claim 5, said dispensing head being adapted to utilize discharge pressure of said first fluid to create a suction pressure to draw said second fluid into said dispensing head for mixing and subsequent discharge with said first fluid.

* * * * *